US005475893A

United States Patent [19]

Sepke

[11] Patent Number: 5,475,893

[45] Date of Patent: Dec. 19, 1995

[54] ADJUSTABLE EDGE BRUSH FOR VACUUM CLEANER

[75] Inventor: Arnold L. Sepke, Hudson, Ill.

[73] Assignee: White Consolidated Industries, Inc., Cleveland, Ohio

[21] Appl. No.: 205,828

[22] Filed: Mar. 4, 1994

[51] Int. Cl.[6] ..... A47L 9/06

[52] U.S. Cl. ..... 15/364; 15/371; 15/373

[58] Field of Search ..... 15/364, 365, 368, 15/371, 373, 416

[56] References Cited

U.S. PATENT DOCUMENTS

| | | | |
|---|---|---|---|
| 1,081,340 | 12/1913 | Spangler | 15/368 |
| 2,348,861 | 5/1944 | Smellie | 15/373 |
| 3,821,831 | 7/1974 | Grover | 15/371 |
| 4,198,727 | 4/1980 | Farmer | 15/416 |

*Primary Examiner*—David Scherbel
*Assistant Examiner*—Terrence R. Till
*Attorney, Agent, or Firm*—Pearne, Gordon, McCoy & Granger

[57] ABSTRACT

A vertically sliding brush is provided along each edge of a vacuum cleaner nozzle. The edge brush is spring biased downwardly. A sliding lever operates the brush between engaged, self-adjusting, and disengaged positions. The edge brush acts to agitate or disturb dirt and debris in corners of a floor to provide improved cleaning.

7 Claims, 3 Drawing Sheets

ADJUSTABLE EDGE BRUSH FOR VACUUM CLEANER

BACKGROUND OF THE INVENTION

1. Field of the Invention

This invention relates generally to the field of vacuum cleaners and specifically to an adjustable edge brush therefor.

2. Description of the Related Art

Vacuum cleaners are commonly equipped with one or more brushes or agitators in or near a suction nozzle of the vacuum. The brush disturbs dirt and debris on a floor or carpet being vacuumed so as to facilitate suction of the dirt and debris into the vacuum cleaner. The brush may be stationary, "floating," or rotating during operation.

Many different configurations of brushes and agitators are known in the prior art. For example, U.S. Pat. No. 4,219,902 to DeMaagd shows a rotary brush disposed in the nozzle of the vacuum cleaner. Stationary brushes are mounted outside the nozzle on sides of the head of the vacuum cleaner. The stationary brushes are angled away from the nozzle to disturb dirt along walls. U.S. Pat. No. 1,129,118 to Pereira shows a sweeper having a rotary brush disposed in the nozzle. Auxiliary brushes are provided on arms pivotally mounted on sides of the sweeper.

Other combinations and configurations of brushes are shown in U.S. Pat. Nos. 2,834,034, 3,409,933, 3,729,769, 4,073,031, 4,198,727, 4,685,170, 4,888,852, and 5,123,141, and Germany Patent No. 2,258,511.

There still exists a need for a vacuum cleaner which is equipped with an improved edge brush. The edge brush should be adjustable between engaged and disengaged positions and should have an automatic height adjustment feature. The edge brush should be inexpensive, durable, simple in construction, and easy to operate. Space requirements should be minimal and the edge brush should not detract from the aesthetic appeal of the vacuum cleaner, which is important in consumer products.

SUMMARY OF THE INVENTION

The present invention provides a vacuum inlet defined by generally parallel first and second side walls and generally parallel front and rear walls joined by said side walls. A rotary agitator may extend between said side walls and generally parallel with the front and rear walls. A vertically movable brush is disposed adjacent and parallel with said first side wall. The brush has bristles extending generally downwardly so as to be engageable with a surface over which the nozzle travels.

The brush is vertically slidable relative to the first side wall and is biased toward a lower position by a resilient device. A lever is connected to adjust the brush to a selected vertical position. A brush holder having a holder rack holds the bristles. A rotatable pinion engages the holder rack. A slidable lever having a slide rack engages the pinion so as to effect vertical movement of the brush by sliding the lever.

A case is secured adjacent the side wall, and the brush holder is slidingly received in the case. A finger extends from the pinion and a projection of the case is disposed so as to be engageable with the finger to retain the brush holder in a selected position. A second projection is disposed so as to be engageable with the finger to retain the brush holder in a second selected position.

A notch in a lower edge of the first side wall permits passage of dirt disturbed by the bristles through the notch into the vacuum inlet.

The invention provides a vacuum cleaner having a suction means and a dirt collection receptacle, a vacuum inlet defined by generally parallel first and second side walls and generally parallel front and rear walls joined by said side walls, and a rotary agitator extending between said side walls and generally parallel with the front and rear walls. An improved edge brush for the vacuum cleaner includes a vertically movable brush disposed adjacent and parallel with said first side wall. The brush has bristles extending generally downwardly so as to be engageable with a surface over which the vacuum cleaner travels.

According to the invention, improved cleaning is accomplished by the edge brush, which disturbs dirt near walls and furniture and reaches into corners. The edge brush is manually or automatically adjustable to provide optimum cleaning for a given situation. The brush is suitable for upright vacuum cleaners or power heads of canister vacuum cleaners.

DESCRIPTION OF THE PREFERRED EMBODIMENTS

Figure 1:
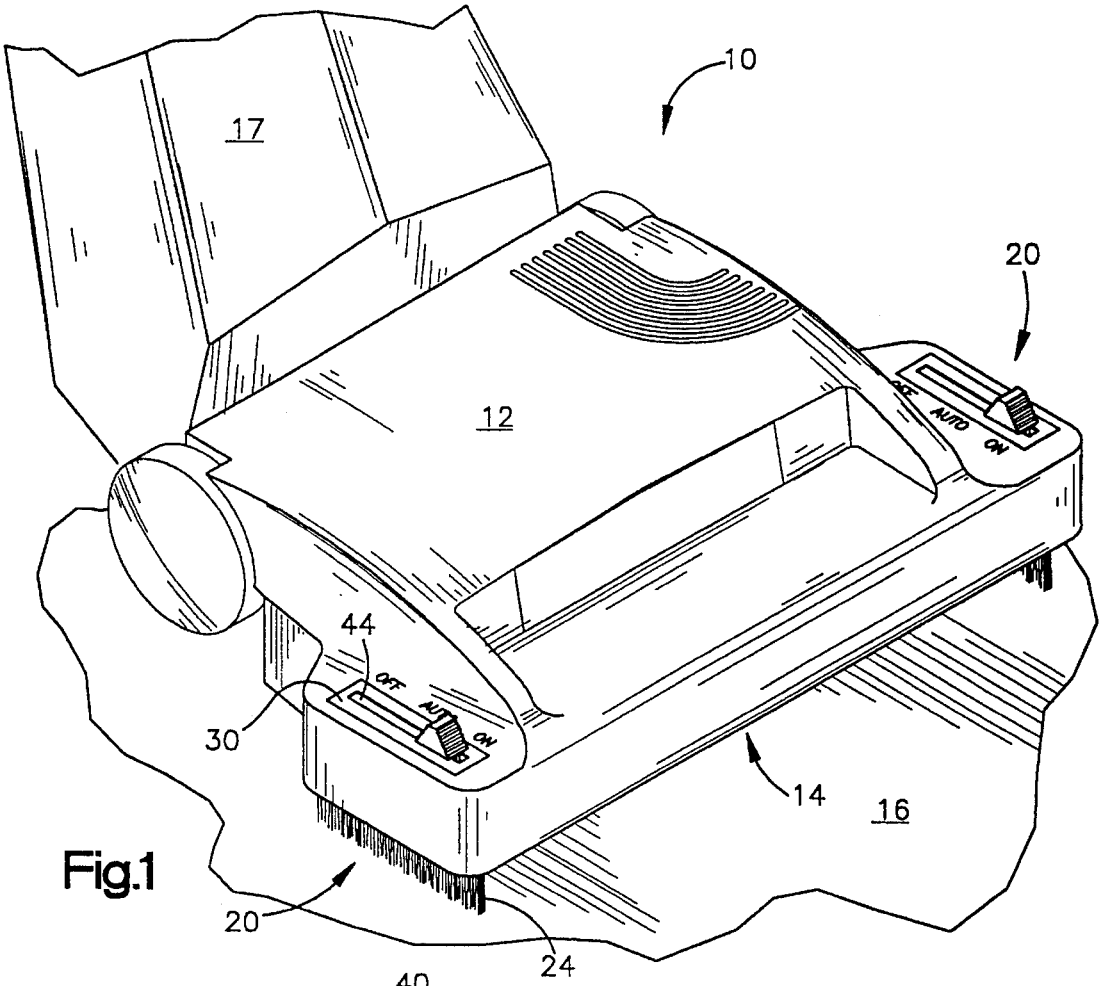
FIG. 1 shows a perspective view of a vacuum cleaner equipped with an edge brush according to the invention.

Referring to FIG. 1, a vacuum cleaner 10 includes a head 12 having a nozzle assembly 14 disposed on a lower face of the head and opening toward a surface or floor 16 to be cleaned. As is known in the art, the vacuum cleaner 10 includes a fan impeller 15 (shown in FIG. 4) or other means for creating an air flow so as to entrain dirt and debris from a surface being cleaned through the nozzle 14 and into a bag 17 or other receptacle subsequent disposal.

Figure 4:
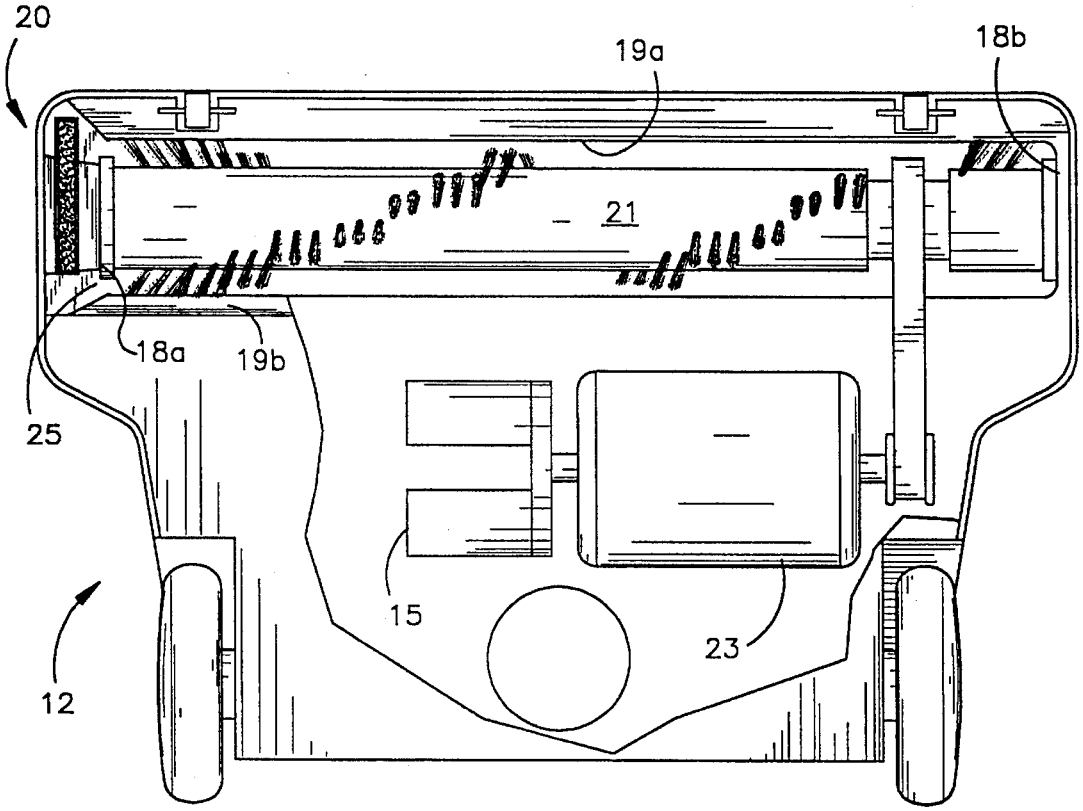
FIG. 4 shows a partially cut away bottom view of a head of a vacuum cleaner equipped with one edge brush.

Referring to FIG. 4, the nozzle assembly 14 includes a vacuum inlet defined by generally parallel side walls 18*a* and 18*b* and generally parallel front and rear walls 19*a* and 19*b* respectively. A rotary agitator such as a rotary brush 21 or a beater bar (not shown) extends between the side walls 18*a* and 18*b*. A motor 23 in the head 12 powers the rotary brush 21 by a belt drive, for example, and may also power the impeller 15. Notches 25 in the side walls 18 define passages through which dirt or other material may pass into the vacuum inlet.

An edge brush 20 is disposed along each side wall 18. Each edge brush 20 extends generally parallel with its corresponding side wall 18*a* or 18*b*. Preferably, the edge brush is disposed as far forwardly and outwardly as is permitted by the assembly configuration so as to facilitate cleaning along edges and in corners.

Figure 2:
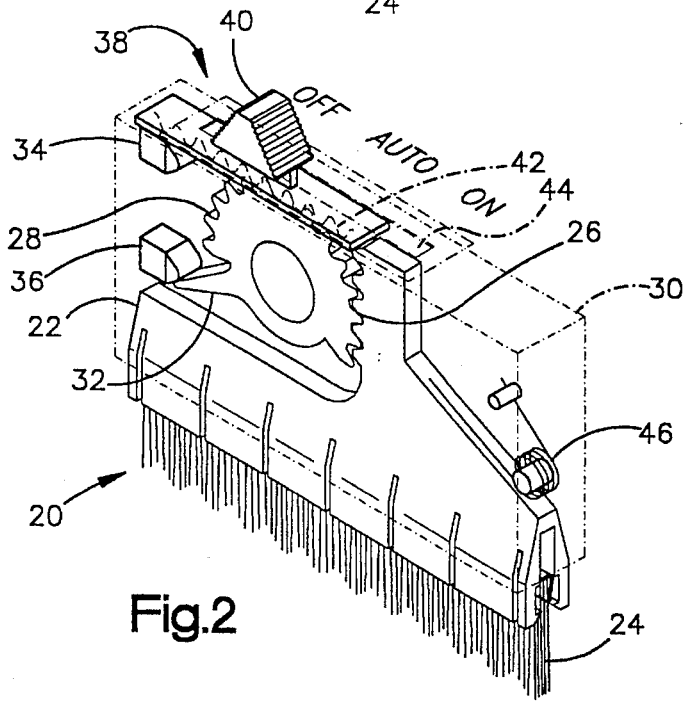
FIG. 2 shows a detailed perspective view of the edge brush assembly.

Referring to FIG. 2, the edge brush 20 includes a brush holder 22 which holds a plurality of bristles 24. The bristles 24 should be relatively stiff so as to disturb dirt and debris, but should not damage the floor 16 or objects over which the vacuum will travel. In practice it has been found that the triangular configuration of the bristles 24 shown provides superior performance over other configurations.

The brush holder 22 is slidingly disposed in a case 30. The case 30 is preferably made of two pieces of molded plastic assembled in a snap-fit "clam shell" arrangement. However, the case may be defined by walls of the vacuum cleaner or the case may be open on a side, a wall of the vacuum cleaner defining another side of the case. The brush holder 22 includes a vertically extending holder rack 26. A pinion 28 is journalled inside the case 30. Teeth of the pinion 28 engage teeth of the holder rack 26. A flexible or semiflexible finger 32 having characteristics of a leaf spring the pinion so as to be engageable with an upper projection 34 and a lower projection 36 of the case 30.

A slide lever 38 having a handle portion 40 and a slide rack portion 42 is slidable in a slot 44 in the case 30 and is positioned such that the teeth of the slide rack 42 engage the teeth of the pinion 28. The brush holder 22 is slidably received within the case 30 such that sliding of the slide lever 38 causes rotation of the pinion 28 thereby causing vertical sliding of the brush holder 22. A bias device, such as a spring 46, biases the brush holder 22 toward a lower position. During assembly of the vacuum cleaner 10, the edge brush 20 can be preassembled inside the case 30 and the case can then be inserted in a suitable molded or cut receptacle adjacent the side wall 18. Preferably the receptacle conforms to the generally rectangular case 30. The case is slid into and snugly held by the receptacle. The case may be secured by a spring biased projection, for example. Alternatively, the case 30 can be secured outside of the side wall 18 by a cover plate or other member fastened over the case by screws or other fastening means. This arrangement would be suitable for adding the edge brush 20 to an existing vacuum cleaner.

Figures 3A, 3B, 3C:
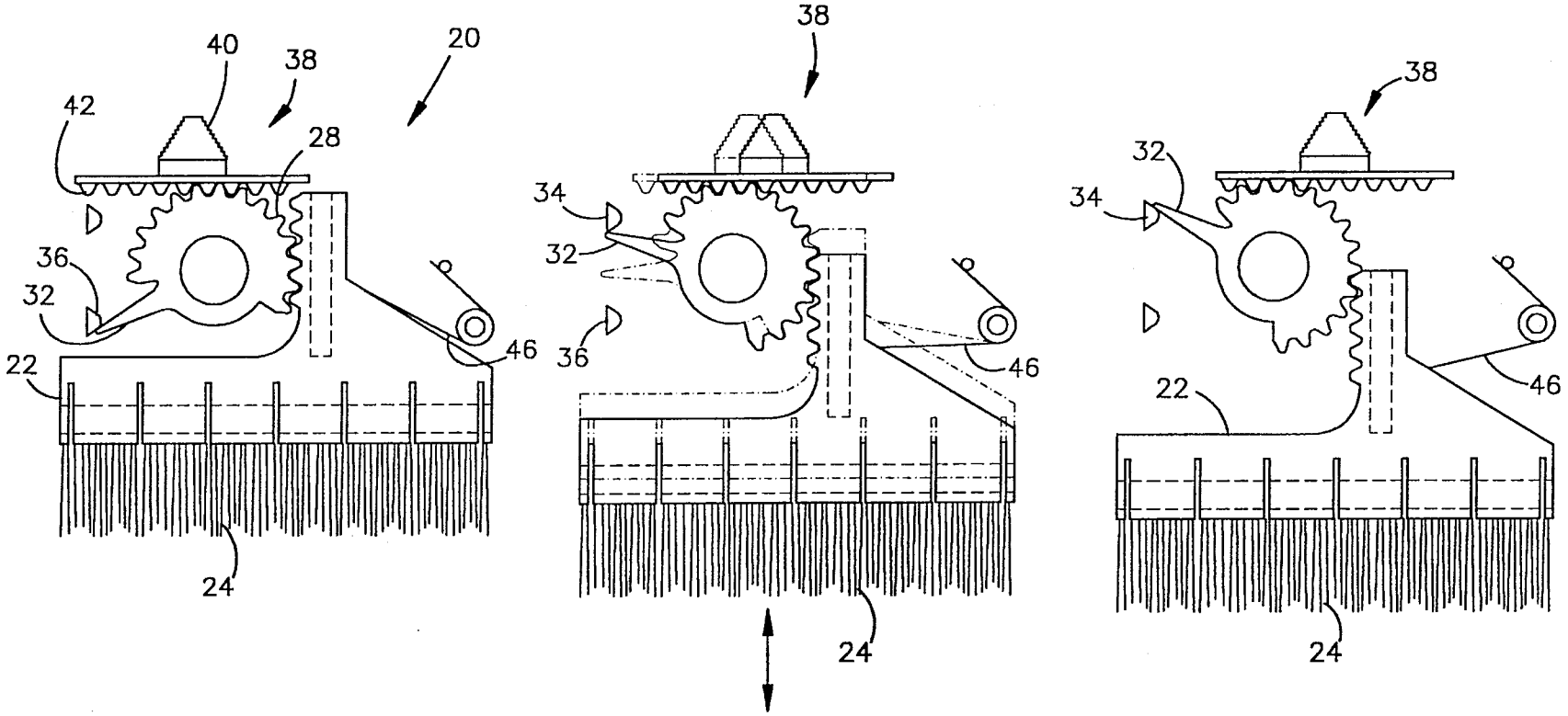
FIG. 3A shows a side elevational view of the edge brush in a retracted position.
FIG. 3B shows a side elevational view of the edge brush in an automatic height adjusting position.
FIG. 3C shows a side elevational view of the edge brush in an engaged position.

Referring to FIGS. 3A, 3B, and 3C, the operation of the edge brush 20 is shown. In an "off" or disengaged position, shown in FIG. 3A, the slide lever is moved toward the back of the head 12 (left in the figure) to raise the brush holder 22 and bristles 24 above the floor 16. The finger 32 of the pinion engages the lower projection 36 of the case to hold the brush in the disengaged position.

As shown in FIG. 3B, moving the slide lever 38 forward (right in the figure) to a middle position places the brush in an "auto" or self-adjusting position. The finger 32 is disposed between the upper and lower projections 34 and 36 to permit limited vertical movement of the brush holder 22 and bristles 24. The spring 46 biases the brush holder 22 toward a lower or engaged position. The brush holder moves vertically as determined by the thickness and texture of a carpet or other floor covering. The vertical movement adjusts to correspond with a height setting of the nozzle. The height of the brush holder and bristles changes as the vacuum cleaner travels from one surface to another.

An "on" or engaged position is shown in FIG. 3C. The slide lever 38 is moved forward so that the finger 32 engages the upper projection 34. The brush holder 22 is fully lowered so that the bristles engage the floor 16.

When the edge brush 20 is in the "on" or "auto" positions, the bristles 24 disturb dirt and debris at edges of the nozzle 14. The edge brushes function independently of the rotary or main brush to provide improved cleaning in areas which are inaccessible to the rotary brush. Each edge brush provides independent automatic adjustment in a simple and compact arrangement.

In an alternative embodiment, the lever 38, pinion 28, and rack 26 can be eliminated. The brush would always be in an "auto" or self-adjusting mode of operation, as described above.

The present disclosure describes several embodiments of the invention, however, the invention is not limited to these embodiments. Other variations are contemplated to be within the spirit and scope of the invention and appended claims.

What is claimed is:

1. A nozzle assembly for a vacuum cleaner, comprising:

a vacuum inlet defined by generally parallel first and second side walls and generally parallel front and rear walls joined by said side walls;

a rotary agitator extending between said side walls and generally parallel with the front and rear walls;

a vertically movable brush disposed adjacent and parallel with said first side wall, said brush having bristles extending generally downwardly so as to be engageable with a surface over which the nozzle travels;

a brush holder holding the bristles, said brush holder having a holder rack;

a rotatable pinion engaging the holder rack; and a slidable lever having a slide rack engaging the pinion so as to effect vertical movement of the brush by sliding the lever.

2. A nozzle assembly according to claim 1, wherein the brush is biased toward a lower position.

3. A nozzle assembly according to claim 1, further comprising a resilient device biasing the brush toward a lower position.

4. A nozzle assembly according to claim 1, further comprising a case secured adjacent the first side wall, the brush holder being slidingly received in the case.

5. A nozzle assembly according to claim 4, further comprising a finger extending from the pinion and a projection of the case disposed to be engageable with the finger to retain the brush holder in a first selected position.

6. A nozzle assembly according to claim 5, further comprising a second projection of the case disposed so as to be engageable with the finger to retain the brush holder in a second selected position.

7. A nozzle assembly according to claim 1, further comprising a notch in a lower edge of the first side wall so as to permit passage of dirt disturbed by the bristles through the notch into the vacuum inlet.

* * * * *